US006917003B2

(12) United States Patent
Dozono et al.

(10) Patent No.: US 6,917,003 B2
(45) Date of Patent: Jul. 12, 2005

(54) SWITCH FOR VEHICLE

(75) Inventors: Shigetaka Dozono, Fukui (JP); Manabu Shiroshita, Fukui (JP); Hiroyuki Kosaka, Fukui (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/877,978

(22) Filed: Jun. 29, 2004

(65) Prior Publication Data

US 2005/0029085 A1 Feb. 10, 2005

(30) Foreign Application Priority Data

Aug. 5, 2003 (JP) ..... 2003-286660

(51) Int. Cl.[7] ..... H01H 9/00

(52) U.S. Cl. ..... 200/61.44; 200/61.73; 200/302.1; 200/306

(58) Field of Search ..... 200/61.41–61.44, 200/61.62, 61.7, 61.71, 61.73, 61.74, 61.76, 61.78, 61.81, 61.82, 293, 302.1, 306

(56) References Cited

U.S. PATENT DOCUMENTS 3,842,222 A * 10/1974 Hogland ..... 200/61.44
4,185,337 A * 1/1980 Sargent et al. ..... 4/300
4,295,134 A * 10/1981 Fairlie-Clarke ..... 340/610
4,503,300 A * 3/1985 Lane, Jr. ..... 200/61.54
4,709,123 A * 11/1987 Yamashita et al. ..... 174/52.1
4,910,366 A * 3/1990 Matsumoto et al. ..... 200/61.89
5,410,293 A * 4/1995 Angerfors ..... 340/454
6,396,013 B1 * 5/2002 Kondo ..... 200/302.3
6,720,506 B2 * 4/2004 Sahashi ..... 200/61.73

FOREIGN PATENT DOCUMENTS

JP 2003-146077 5/2003

* cited by examiner

*Primary Examiner*—Michael A. Friedhofer
(74) *Attorney, Agent, or Firm*—Wenderoth, Lind & Ponack, L.L.P.

(57) ABSTRACT

A switch is used to detect opening/closing of a car door or the like in a vehicle, and the switch can be provided with a nice operation feeling and stable performance. Thin corrugated sections are provided on a cover that covers a switching-element, connection points of lead wires and lower portions of a housing of the switch. The switch performs a nice operation feeling with quick response, as upon pushing the cap, the corrugated sections of the cover expand outward to prevent air in the switch from being compressed.

8 Claims, 6 Drawing Sheets

SWITCH FOR VEHICLE

FIELD OF THE INVENTION

The present invention relates to a switch for a vehicle, which is to be mounted mainly in a car to detect opening/closing of car doors or the like.

BACKGROUND ART

Nowadays, most cars have a switch for a vehicle (hereafter referred to as a switch) mounted in car doors to control switching of room lights or to detect locking of doors according to opening/closing of the doors.

The switch is typically covered with rubbers for waterproofing as the switch is mounted in a position of a door subject to getting wet by raindrops or the like when the door is open.

The conventional switch is described with reference to FIGS. 5 and 6. FIG. 5 shows a cross-sectional view of a conventional switch. FIG. 6 shows car 40 as an example of a vehicle.

An upper portion of substantially cylindrical shaped inner case 2 made of insulation resin is fitted securely into substantially cylindrical shaped outer case 1 made of insulation resin as shown in FIG. 5. Stationary contacts 3 and 4 made of conductive metal are disposed facing each other on right and left hand side inner wall surfaces of inner case 2. Substantially U-shaped movable contact 6 made of conductive metal is mounted on operating body 5. Both ends of movable contact 6 attach to stationary contacts 3 and 4 resiliently. Movable contact 6 thus forms a switching-element to connect/disconnect stationary contacts 3 to 4 electrically.

Rubber cap 7 is disposed on the top surface of outer case 1 covering the top of operating body 5 that protrudes out of an aperture of outer case 1 to prevent raindrops from coming into gaps between the aperture and operating body 5. Coiled spring 8 is mounted between the bottom surface of operating body 5 and the base surface of inner case 2 in a slightly sagging condition, causing operating body 5 to be biased upward.

The top ends of a plurality of conductive metal lead wires 9 coated with insulation resin or the like are connected to the bottom ends of stationary contacts 3 and 4 that extend out of the bottom surface of inner case 2 via conductive metal connector 10.

While the upper portion of rubber cover 11 placed in contact with the periphery of the lower portion of outer case 1 covers the bottom ends of stationary contacts 3 and 4, the top ends of lead wires 9 and connector 10, lead wires 9 that have been pressed into the bottom surface of cover 11 extend downward.

Namely, cover 11 covers the bottom ends of stationary contacts 3 and 4 extending out of the bottom surface of inner case 2, the conductive portion of connector 10 or the like that couples stationary contacts 3 and 4 with lead wires 9, and slight gaps of the fitting portion of inner case 2 to outer case 1. The conductive portions of the switch are thus protected from moisture condensation or water infiltration.

The switch is mounted in door part 20 of car door 30, with bottom ends of lead wires 9 being connected to electronic circuits (not shown) of car 40.

Upon closing car door 30, door part 20 pushes the top of operating body 6 while depressing cap 7 causing operating body 5 to move downward while depressing spring 8.

Then both ends of movable contact 6 mounted on operating body 5 depart from stationary contacts 3 and 4, and attach right and left hand side inner wall surfaces of inner case 2 resiliently, causing the switching-element to open and for instance room lights turn off.

On the other hand, upon opening car door 30, door part 20 releases operating body 5 from the pushing force. Subsequently, a biasing force of spring 8 moves movable contact 6 upward with operating body 5, causing both ends of movable contact 6 to contact stationary contacts 3 and 4 resiliently, thereby causing the switching-element to close and for instance room lights or the like turn on.

As aforementioned, the switch configuration has a function capable of controlling room lights or the like or checking door locking according to opening/closing detection of car doors.

Japanese Patent Unexamined Application No. 2003-146077 discloses the switch with such a configuration.

In the conventional technology, however, while cap 7 that has no vent is depressed, operation air trapped in cap 7 is compressed as the switch is sealed air-tight internally by cap 7 and cover 11. As a result, the drawback is that the switch cannot operate in quick response, and cap 7 and operating body 5 are apt to return unstably after the pushing force is released.

The present invention aims at solving the conventional problems and can provide a switch with an excellent operating feeling and stable switching performance.

SUMMARY OF THE INVENTION

A switch for a vehicle according to this invention comprises: substantially cylindrical shaped cases (which together constitute a housing); an operating body housed in the cases upward and downward movably; a switching-element to connect/disconnect electrically according to the upward and downward movements of the operating body; lead wires connected to the switching-element and extending externally; and a cover that covers the switching-element, connection points of the lead wires and lower portions of the cases; wherein the cover is provided with a plurality of thin corrugated sections.

Moreover, the vehicle switch may further comprise: substantially cylindrical shaped cases (together, a housing); an operating body housed in the cases upward and downward movably; a switching-element to connect/disconnect electrically according to the upward and downward movements of the operating body; lead wires connected to the switching-element and extending externally; and a cover that covers the switching-element, connection points of the lead wires and lower portions of the cases; wherein the cover is provided with an elongated hollow tube extending externally.

DETAILED DESCRIPTION OF PREFERRED EMBODIMENTS

Figure 1:
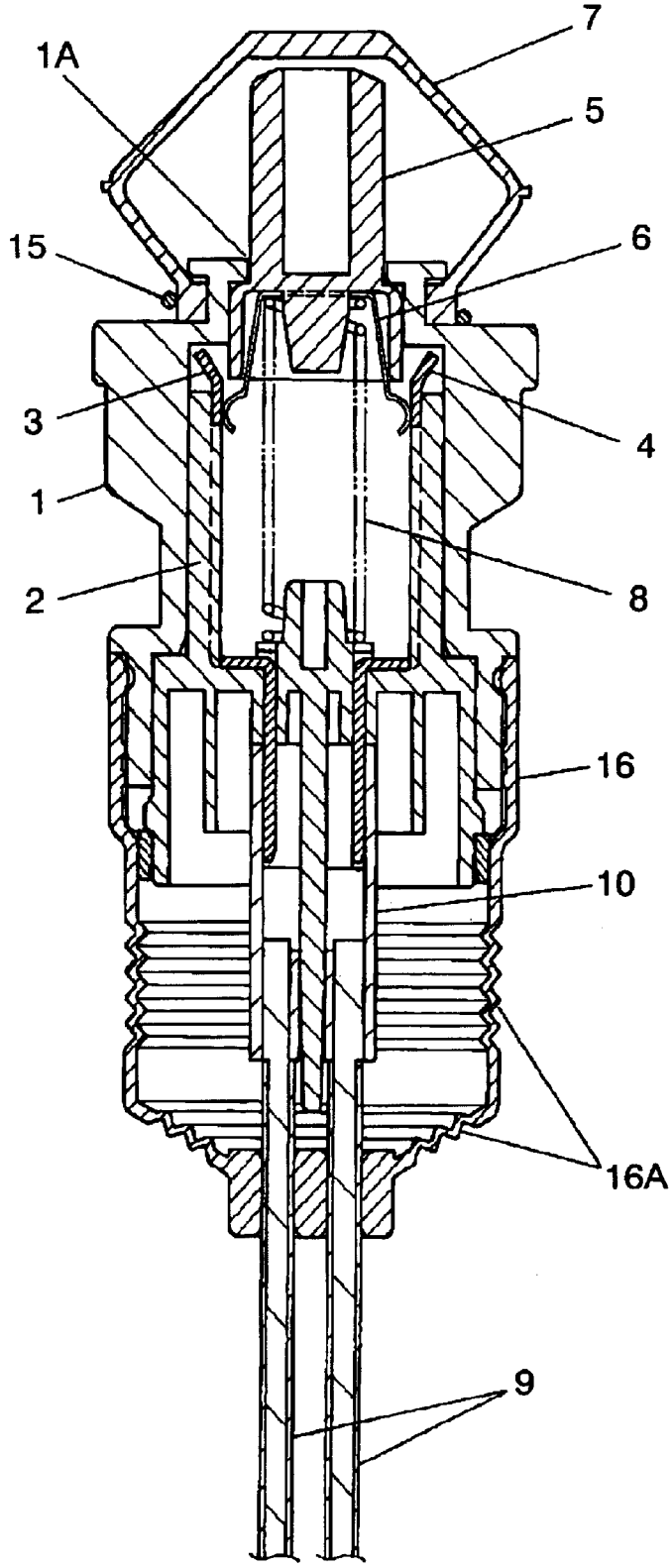
FIG. 1 shows a cross-sectional view of a vehicle switch used in preferred embodiment 1 of the present invention.
Figure 2:
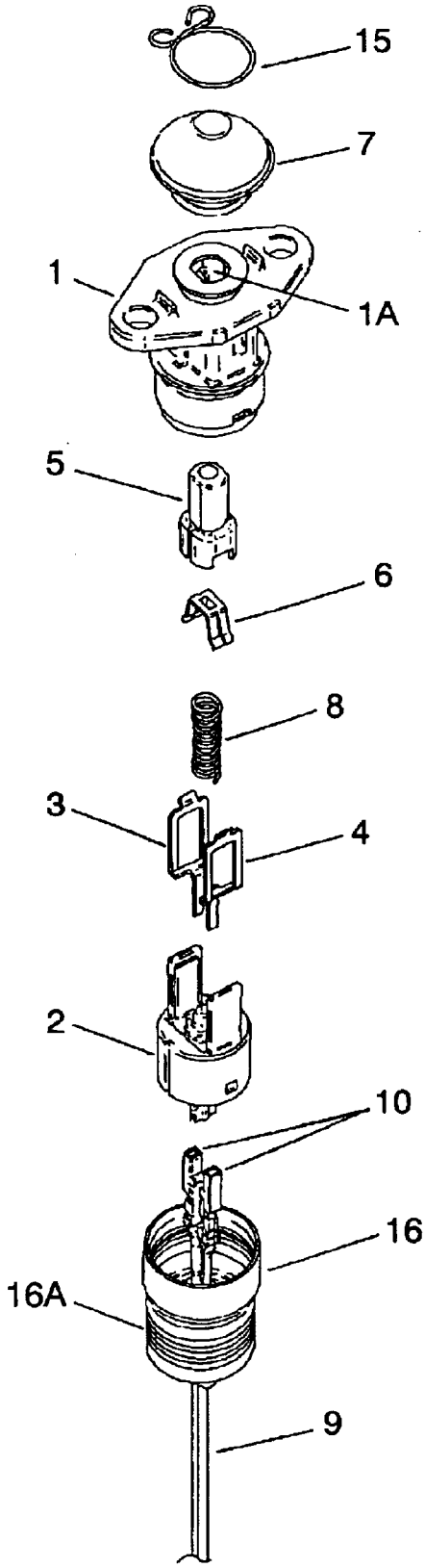
FIG. 2 shows an exploded perspective view of the vehicle switch used in preferred embodiment 1 of the present invention.

The preferred embodiments of the present invention are described with reference to FIGS. 1 to 4. The drawings are schematic and do not show the positions and dimensions correctly. Elements similar to those described in the conventional art have the same reference marks and the detailed thereof is omitted.

(Preferred Embodiment 1)

Substantially cylindrical shaped outer case 1 and inner case 2 are made of insulation resin such as polyacetal, polybutylene terephthalate (PBT) or the like. Upper portion of inner case 2 is fitted securely in outer case 1. Stationary contacts 3 and 4 made of conductive metal such as copper alloy or the like are disposed facing each other on right and left hand side inner wall surfaces of inner case 2.

Operating body 5 made of insulation resin such as polyacetal, polyamide or the like is housed in case 2 so as to be freely movable upwardly and downwardly. Both ends of substantially U-shaped movable contact 6, made of conductive metal such as copper alloy or the like, contact stationary contacts 3 and 4 resiliently. Movable contact 6 thus forms a switching-element with stationary contact 3 and stationary contact 4 in order to electrically connect and disconnect lead wires 9 connected to the stationary contacts 3, 4, respectively.

Cap 7 made of rubber or elastomer is mounted at the periphery of aperture 1A on the top surface of outer case 1, being clamped by an elastic ring 15 made of steel wire or the like. Covering the top of operating body 5 that protrudes out of aperture 1A, cap 7 inhibits the infiltration of water through gaps between aperture 1A and periphery of operating body 5.

Coiled spring 8 made of steel wire or the like is mounted between the bottom surface of operating body 6 and the base surface of inner case 2 in a slightly sagging condition, causing operating body 5 to be biased upward. A plurality of lead wires 9 is made of conductive metal wires coated with insulation resin such as polyethylene, polyvinyl chloride or the like. The top ends of the lead wires 9 are connected to the bottom ends of stationary contacts 3 and 4 extending out of the bottom surface of inner case 2 via conductive metal connector 10 made of copper alloys or the like.

Cover 16 is made of rubber or elastomer. Examples of rubber include chloroprene rubber, NBR, ethylene-propylene rubber and silicone rubber or the like. Examples of elastomers includes polyamide system elastomer, urethane elastomer and silicone elastomer or the like. The upper portion of cover 16 is appressed to the lower portion of outer case 1, covering the lower ends of stationary contacts 3 and 4, the top ends of lead wires 9 and connector 10. Lead wires 9 that have been pressed into the bottom surface of cover 16 extend downward.

Moreover, cover 16 is provided with a plurality of thin corrugated sections 16A in its central and lower portions. Cover 16 covers: the bottom ends of stationary contacts 3 and 4 that extend out of the bottom surface of inner case 2; the conductive portion of connector 10 or the like that couples stationary contacts 3 and 4 with lead wires 9; and slight gaps in the fitting portion of inner case 2 to outer case 1. The configuration thus inhibits moisture condensation on internal conductive parts or water infiltration to the switch.

The switch is mounted in door part 20, with the bottom ends of lead wires 9 connected to electronic circuits (not shown) of the car.

Upon closing car door 30, door part 20 will push the top of operating body 5 while depressing cap 7. Then, the downward movement of operating body 5 while depressing spring 8 causes both ends of movable contact 6 mounted on operating body 5 to depart from stationary contacts 3 and 4 as shown in the cross-sectional view in FIG. 3. Subsequently, both ends of movable contact 6 attach to right and left hand side inner wall surfaces of inner case 2 resiliently, causing the switching- element to open and for instance room lights turn off.

Figure 3:
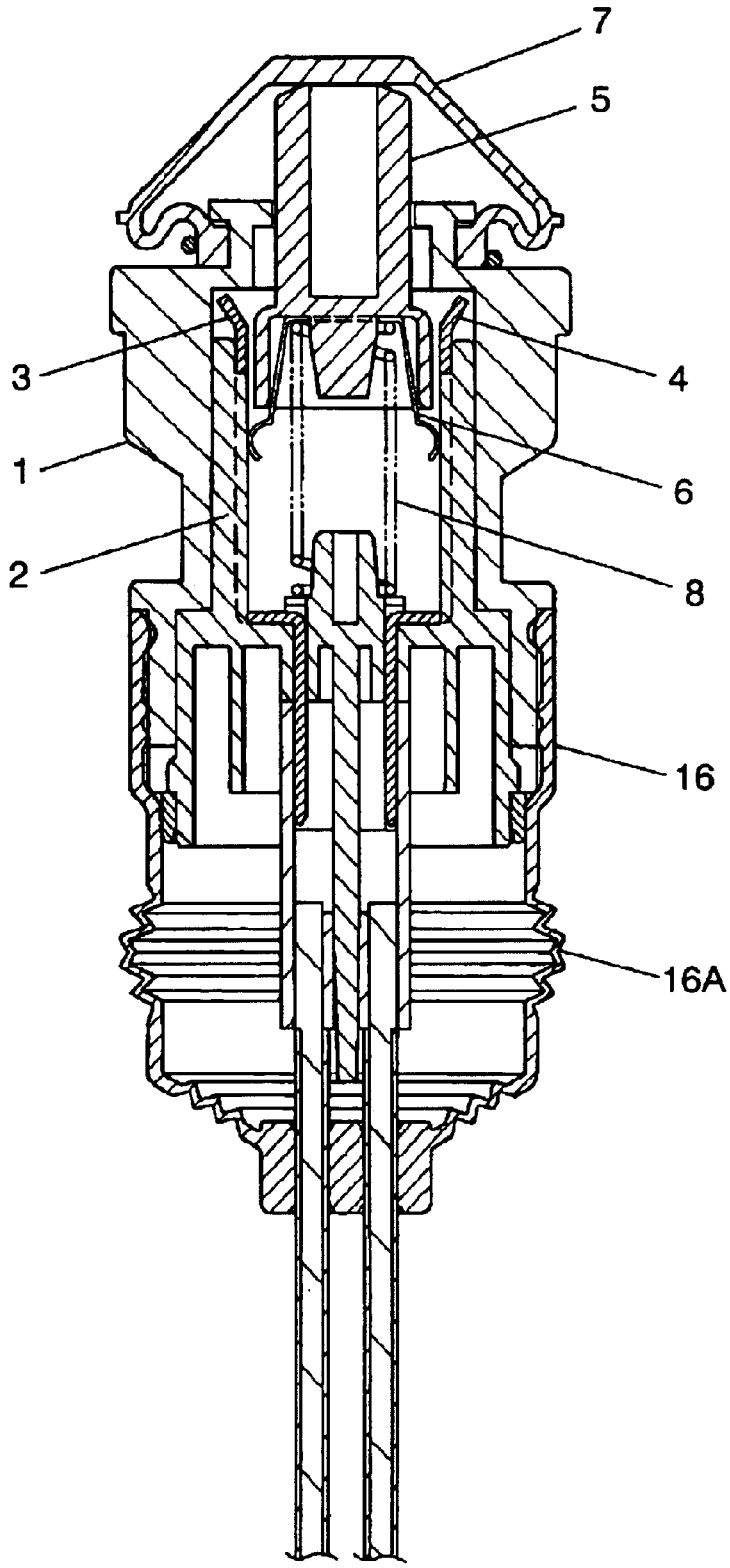
FIG. 3 shows a cross-sectional view of the vehicle switch in a depressed condition according to preferred embodiment 1 of the present invention.

At this time, being compressed by the pushing operation, internal air of cap 7 flows into cover 16 from slight gaps in the fitting portion of inner case 2 to outer case 1 through inner case 2, which causes cover 16 to increase in internal air pressure. However, thin corrugated sections 16A provided in the central and lower portions of cover 16 expand outward corresponding to the increased air pressure as shown in FIG. 3. As a result, the configuration can prevent a force needed to move operation body 5 via cap 7 from increasing. The increase of the force is caused by the internal compressed air of the switch.

On the other hand, upon opening car door 30, door part 20 departs from operating body 5 while releasing the pushing force. Subsequently, a biasing force of spring 8 moves movable contact 6 upward with operating body 5, causing both ends of movable contact 6 to contact stationary contacts 3 and 4 resiliently, thereby causing the switching-element to close and room lights or the like turn on as shown in FIG. 1.

At this time, along with cap 7 returning to an initial state, corrugated sections 16A of cover 16, once expanded, also return to an initial state as air trapped in cover 16 will flow back into cap 7 through inner case 2.

Upon pushing cap 7, corrugated sections 16A of cover 16 expand outward. The configuration can prevent a force needed to move operation body 5 via cap 7 from increasing. The increase of the force is caused by the internal compressed air of the switch. Upon releasing cap 7, operating body 5 and cap 7 can return to the initial state smoothly by causing air trapped in cover 16 to flow back into cap 7.

As mentioned above, the switch described in this embodiment has cover 16, which covers the switching-element, connection points of lead wires 9 and lower portions of the case, and which is provided with a plurality of thin corrugated sections 16A. The configuration can, therefore, provide the switch with a nice operation feeling and stable performance as air trapped in the switch is not compressed due to corrugated sections 16A expanding outward, upon pushing of cap 7.

(Preferred Embodiment 2)

Preferred embodiment 2 is described with reference to FIG. 4. Elements similar to those described in preferred embodiment 1 have the same reference marks and the detailed description thereof is omitted.

Figure 4:
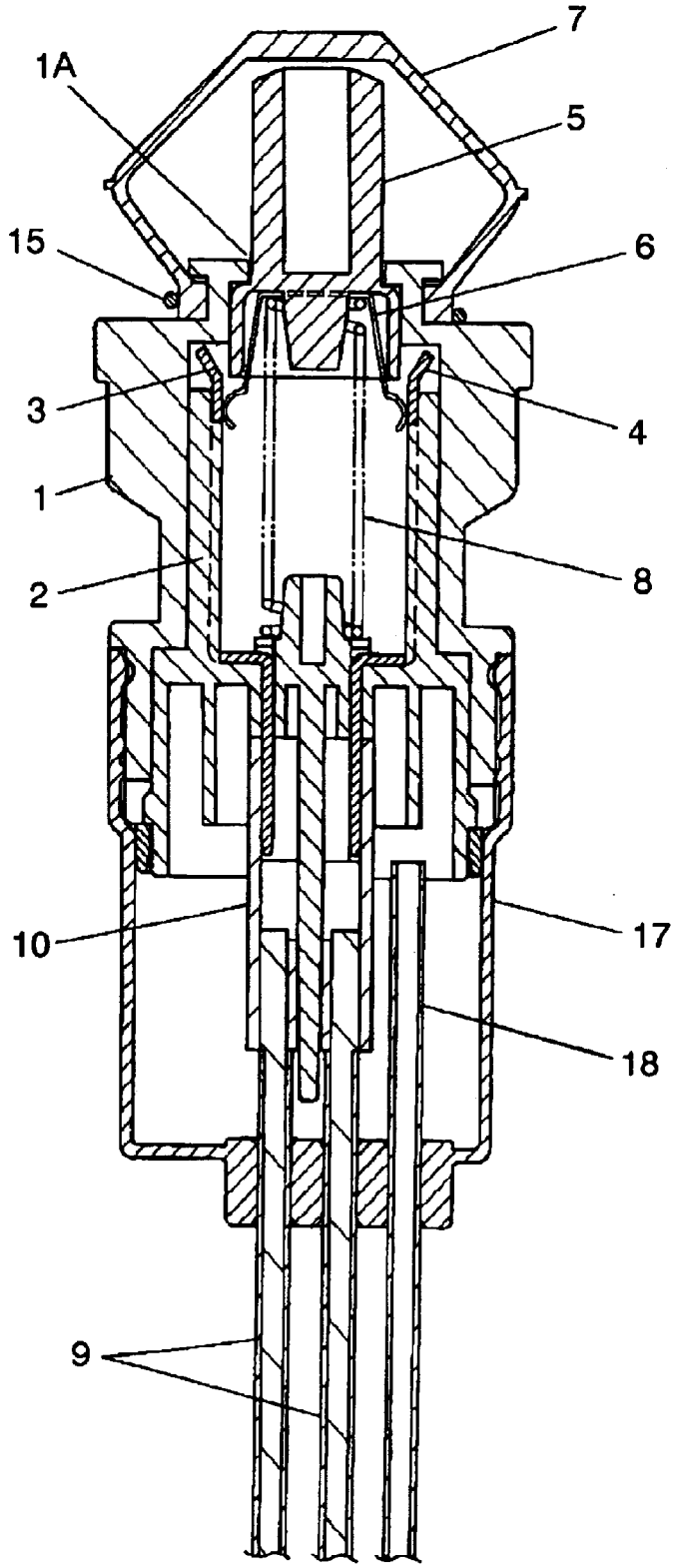
FIG. 4 shows a cross-sectional view of the vehicle switch used in preferred embodiment 2 of the present invention.
Figure 5:
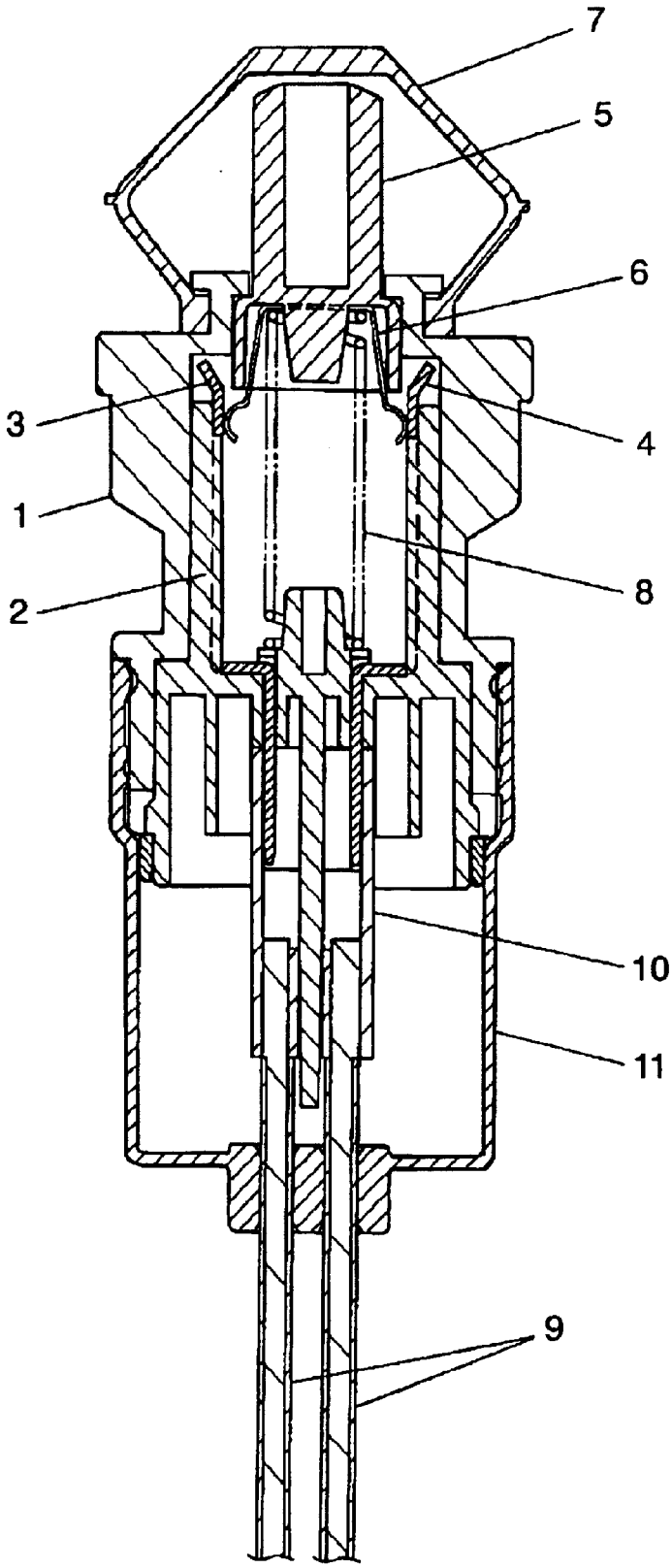
FIG. 5 PRIOR ART
FIG. 5 shows a cross-sectional view of a conventional vehicle switch.

In FIG. 4, the following are similar to preferred embodiment 1: that the upper portion of inner case 2 is fitted securely into outer case 1, and stationary contacts 3 and 4 are disposed facing each other on right and left hand side inner wall surfaces of inner case 2; and that both ends of movable contact 6 contact stationary contacts 3 and 4 resiliently to form a switching-element.

Moreover, the following are similar to preferred embodiment 1: that cap 7 is mounted clamped by an elastic ring 15 at the periphery of aperture 1A on the top surface of outer case 1; that coiled spring 8 is mounted between the bottom surface of operating body 5 and the base surface of inner case, 2 in a slightly sagging condition, causing operating body 5 to be biased upward; and that the top ends of lead wires 9 are connected to the bottom ends of stationary contacts 3 and 4 extending out of the bottom surface of inner case 2 via connector 10.

Additionally, the following are similar to preferred embodiment 1: that the top of cover 17 made of rubber or elastomer is appressed to the lower portion of outer case 1, covering the lower ends of stationary contacts 3 and 4, the top ends of lead wires 9 and connector 10; and that lead wires 9 that have been pressed into the bottom surface of cover 17 extend downward.

The difference from preferred embodiment 1 is that hollow tube 18 made of insulation resin such as polyethylene, polyvinyl chloride or the like is also pressed into the bottom surface of cover 17. The top end of hollow tube 18 is disposed in the internal space of cover 17, and the bottom end extends out of the bottom surface of cover 17 accompanying lead wires 9. As shown in FIG. 4, the top end of hollow tube 18 is remote from the bottom end of cover 16, and the bottom end of hollow tube 18 is remote from the bottom end of cover 16.

The switch with this configuration is mounted in door part 20, with the bottom ends of lead wires 9 connected to electric circuits (not shown) of the vehicle and with the bottom ends of hollow tube 18 extended to a position of the vehicle free from rainwater or the like.

Upon closing car door 30, door part 20 will push the top of operating body 5 while pushing cap 7, and operating body 5 will move downward while pushing spring 8. Then, departing from stationary contacts 3 and 4, both ends of movable contact 6 mounted on operating body 5 contact right and left hand side inner wall surfaces of inner case 2 resiliently, causing the switching-element to open and for instance room lights turn off.

At this time, air in cap 7 depressed by the pushing force flows into cover 17 through slight gaps in the fitting portion of inner case 2 to outer case 1 via inner case 2, causing cover 17 to increase in internal air pressure. The internal high pressure air will flow out through hollow tube 18 to a predetermined position of the car. The configuration prevents a force needed to move operation body 5 via cap 7 from increasing. The increase of the force is caused by the internal compressed air of the switch.

Upon opening car door 30, door part 20 departs from operating body 5 while releasing the pushing force, causing movable contact 6 to move upward with operating body 5 by a biasing force of spring 8, Then both ends of movable contact 6 contact stationary contacts 3 and 4 resiliently, causing the switching-element to close and for instance room lights or the like turn on as shown in FIG. 4.

At this time, air is sucked into cover 17 from outside through hollow tube 18 allowing cap 7 to return to the initial state. Namely, the configuration allows operating body 5 and cap 7 to return to the initial states smoothly by exhausting or sucking air in cover 17 through hollow tube 18 according to the loading or unloading of pushing force.

As described above, the configuration of embodiment 2 does not compress internal air of the switch due to hollow tube 18 being extended out of cover 17 that covers the switching-element, coupling points of lead wires 9 and lower portions of the cases.

The configuration can, therefore, provide the switch with a ration feeling and stable performance.

Additionally, as described in preferred embodiments 1 and 2, cap 7 mounted clamped by an elastic ring 15 at the periphery of aperture 1A on the top surface of outer case 1 can inhibit the infiltration of water through gaps between aperture 1A and periphery of operating body 5 more reliably.

The switch configuration of the present invention provides the cover that covers the switching-element, connection points of the lead wires and lower portions of the cases with a plurality of thin corrugated sections. The switch can provide a nice operation feeling and stable performance, as upon pushing the cap, corrugated sections 16A of cover 16 expand outward to prevent air in the switch from being compressed.

Moreover, another switch configuration of the present invention provides the cover that covers the switching-element, connection points of the lead wires and lower portions of the cases with a hollow tube extending outward. The switch can provide a nice operation feeling and stable performance, as upon pushing the cap, air in the switch flows out through the hollow tube.

Figure 6:
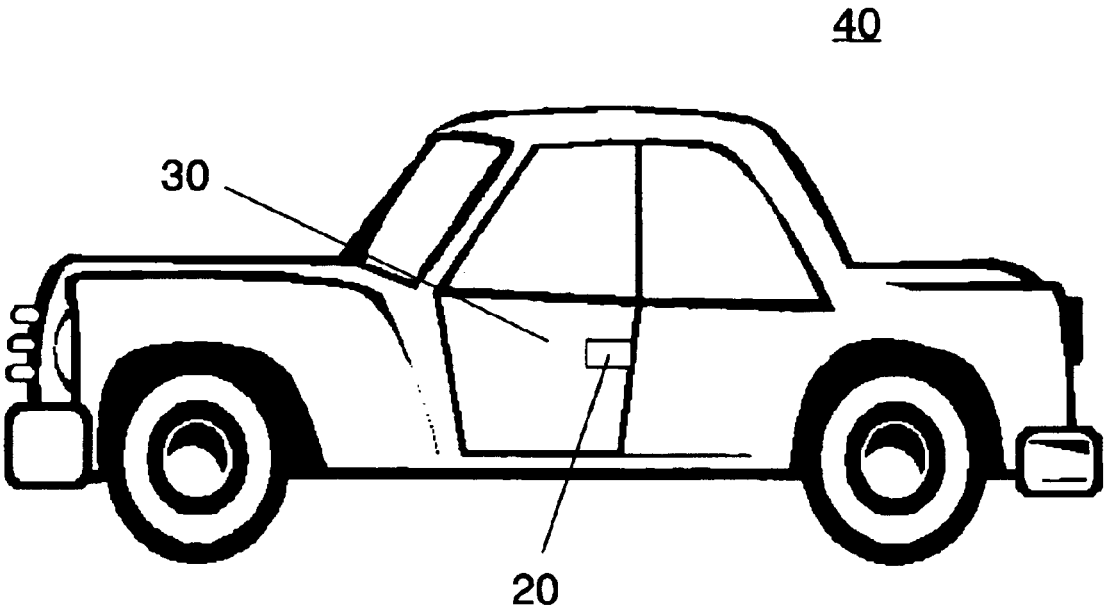
FIG. 6 shows a perspective view of a car as an example of a vehicle.

Additionally, the door part to mount the switch of the present invention is not so limited to the portion for instance as shown in FIG. 6.

As described above, the present invention can realize the switch to detect opening/closing of car doors or the like with a nice operation feeling and stable performance.

What is claimed is:

1. A vehicle switch comprising:

a substantially cylindrical housing having first and second end portions;

an operating body mounted in said housing for reciprocable movement along a direction between said first and second end portions;

a cap covering said operating body and said first end portion of said housing;

electrical lead wires;

an electrical switching-element provided in said housing and arranged to electrically connect and disconnect said electrical lead wires upon movement of said operating body along said direction; and a cover arranged to cover said electrical switching-element, connection points of said lead wires, and said second end portion of said housing;

wherein said housing, said cap, and said cover together define an enclosed space;

wherein said electrical lead wires extend from inside to outside of said enclosed space; and wherein said cover has a plurality of thin corrugated sections that expand outwardly to accommodate displaced air when said cap is depressed upon application of an external pressing force to said operating body to cause said operating body to move in said direction toward said second end portion and that return to an unexpanded state when said operating body moves in said direction toward said first end portion.

2. A vehicle switch according to claim 1, wherein said electrical switching-element comprises stationary contacts that are fixed to said housing and electrically connected to said electrical lead wires, respectively, and a movable contact mounted for movement with said operating body and having ends respectively slidable relative to said stationary contacts such that, upon movement of said operating body in said direction toward said first end portion, said ends of said movable contact make contact with said stationary contacts and, upon movement of said operating body in said direction toward said second end portion, said ends of said movable contact move out of contact with said stationary contacts.

3. A vehicle switch according to claim 1, wherein said housing comprises a substantially cylindrical outer case and a substantially cylindrical inner case secured to said substantially cylindrical outer case.

4. A vehicle switch according to claim 1, further comprising a spring mounted in said housing and biasing said operating body in said direction toward said first end portion.

5. A vehicle switch comprising:

a substantially cylindrical housing having first and second end portions;

an operating body mounted in said housing for reciprocable movement along a direction between said first and second end portions;

a cap covering said operating body and said first end portion of said housing;

electrical lead wires;

an electrical switching-element provided in said housing and arranged to electrically connect and disconnect said electrical lead wires upon movement of said operating body along said direction;

a cover arranged to cover said electrical switching-element, connection points of said lead wires, and said second end portion of said housing;

wherein said housing, said cap, and said cover together define an enclosed space;

wherein said electrical lead wires extend from inside to outside of said enclosed space;

wherein a hollow tube extends through an opening formed in said cover from inside to outside of said enclosed space; and wherein said hollow tube is elongated and is arranged so as to have a first end disposed within said enclosed space at a location remote from said opening formed in said cover, and a second end disposed outside said enclosed space at a location remote from said opening formed in said cover.

6. A vehicle switch according to claim 5, wherein said electrical switching-element comprises stationary contacts that are fixed to said housing and electrically connected to said electrical lead wires, respectively, and a movable contact mounted for movement with said operating body and having ends respectively slidable relative to said stationary contacts such that, upon movement of said operating body in said direction toward said first end portion, said ends of said movable contact make contact with said stationary contacts and, upon movement of said operating body in said direction toward said second end portion, said ends of said movable contact move out of contact with said stationary contacts.

7. A vehicle switch according to claim 5, wherein said housing comprises a substantially cylindrical outer case and a substantially cylindrical inner case secured to said substantially cylindrical outer case.

8. A vehicle switch according to claim 5, further comprising a spring mounted in said housing and biasing said operating body in said direction toward said first end portion.

* * * * *